United States Patent [19]

Baker et al.

[11] 4,377,462

[45] Mar. 22, 1983

[54] TUNING FORK SHAPED ANODES FOR ELECTROLYSIS CELLS

[75] Inventors: Richard F. Baker; Otis C. Taylor, both of Lake Jackson, Tex.

[73] Assignee: The Dow Chemical Company, Midland, Mich.

[21] Appl. No.: 224,364

[22] Filed: Jan. 12, 1981

[51] Int. Cl.[3] ..... C25B 11/02; C25B 13/06; C25B 13/08

[52] U.S. Cl. ..... 204/253; 204/267; 204/288; 204/289; 204/295; 204/296; 204/282; 204/283

[58] Field of Search ..... 204/252, 283, 253–258, 204/295, 282, 263–266, 267–269, 270, 242, 288–289

[56] References Cited

U.S. PATENT DOCUMENTS

| | | | |
|---|---|---|---|
| 3,849,280 | 11/1974 | Raetzsch et al. | 204/256 |
| 3,910,827 | 10/1975 | Raetzsch et al. | 204/98 |
| 3,928,150 | 12/1975 | Rahn et al. | 204/98 |
| 3,930,981 | 1/1976 | De Nora et al. | 204/256 |
| 3,932,261 | 1/1976 | Kircher et al. | 204/242 X |
| 4,032,423 | 6/1977 | Cunningham | 204/254 |
| 4,059,495 | 11/1977 | De Nora et al. | 204/98 |
| 4,073,715 | 2/1978 | De Nora et al. | 204/256 |
| 4,130,468 | 12/1978 | Oronzio De Nora et al. | 204/98 |
| 4,132,622 | 1/1979 | Kenney | 204/288 X |
| 4,136,004 | 1/1979 | Kamarian et al. | 204/252 X |
| 4,175,024 | 11/1979 | Darlington | 204/252 |
| 4,288,310 | 9/1981 | Knight et al. | 204/252 |

*Primary Examiner*—Donald R. Valentine
*Attorney, Agent, or Firm*—M. W. Barrow

[57] ABSTRACT

Disclosed is an anode-cathode assembly useful in brine electrolysis cells. Principally featured is an anode-cathode assembly wherein the anode is C- or U-shaped, and is fitted around the cathodes instead of being fitted between two cathodes.

9 Claims, 6 Drawing Figures

TUNING FORK SHAPED ANODES FOR ELECTROLYSIS CELLS

BACKGROUND OF THE INVENTION

For a number of years, one of the more popular commercial ways of producing chlorine and caustic by electrolysis has been by the use of electrolysis cells in which arrays of rectangular prism-shaped parallel anodes were made of solid, relatively thick graphite, which anodes were between arrays of rectangular prism shaped, hollow cathode pockets. These cathode pockets were usually coated with diaphragms such as asbestos.

In recent years much research has gone into developing improvements in this type of cell in general, and in improvements in the anodes in particular. A number of types of metal anodes have been developed which could tolerate the highly corrosive environment within the anolyte compartment of these cells as well or better than the graphite blocks or blades. These metals are the valve metals such as titanium and tantalum. Several types of anode made from these metals have been designed to replace the relatively thick graphite blocks. In many instances where it was desired to use these metal anodes, it was, and often still is, also desirable to retain as much of the existing cells as possible. That is, only replacing the graphite anodes with the new metal anodes. The working faces of these new anodes were made of the valve metals and coated with a catalyst such as ruthenium oxide and cobalt oxide.

Generally these valve metals were and are much too expensive to merely replace the thick blocks of graphite with blocks of these metals of the same thickness. However, one single thin metal sheet could not be inserted as an anode between the cathode pockets and have a sufficiently narrow gap between the anodes and cathodes for satisfactory commercial operation. In commercial chlor-alkali electrolysis production cells, this gap width is very important. The wider the gap, the more waste these is of electrical power due to the increased electrical resistance in the anolyte. Yet if this anode-to-cathode gap is too small, there results such poor circulation of the brine in the gap that there is an unacceptable increase of undesirable, diaphragm destroying chemicals produced in this too narrow gap. Further during cell assembly a wide anode-cathode gap was, and is, desired to prevent the anodes from damaging the diaphragms, such as by scraping holes in them, as the array of anodes are slipped between the diaphragm-coated cathode pockets.

Hence adjustable anode assemblies have been made from these valve metals that could be slid between the cathodes. These assemblies generally involve using several parts with extensive complicated welding or other attaching means for these parts. See U.S. Pat. Nos. 3,674,676 (Fogelman) and 3,941,676 (Pulver).

Moreover, another undesirable feature has been observed. Each cathode pocket in a row of cathode pockets in a cell should have an anode assembly on each side of it, including the terminal cathode pockets of that row. This means, for example, that if a row contains twenty (20) cathode pockets, then twenty-one (21) of the anode assemblies would be required. Without an anode assembly on each side of the terminal cathode pockets, these terminal cathodes would be quickly corroded.

Hence, it would be advantageous to have an electrode assembly utilizing a dimensionally stable anode which is simple to construct, and is less expensive than presently available. Further, it would be advantageous to have an electrode assembly which provides a predetermined anode-cathode gap width which also protects the diaphragm, or other selective barrier, from damage during cell assembly. In addition it would be advantageous to have an electrode assembly which required no more anode assemblies than cathode assemblies in a row of interleaved anodes and cathode pocket usually found in an electrolysis cell, particularly a chlorine-caustic electrolytic cell. These and other advantages are provided by the present invention.

SUMMARY OF THE INVENTION

This is an improvement for electrolysis cells which electrolyzes brine. Some types of such cells are known to contain a plurality of spaced, vertically oriented anodes and cathodes whose working faces are flat and substantially parallel to each other.

These anodes are attached at one edge to an anode base while the cathodes are attached to the cathode base which may or may not be parallel to the anode base.

The improvement of this invention comprises anodes which are U-shaped, C-shaped, or tuning fork-shaped; and which are attached to an anode base at the base of their U-shape in such a fashion so that they fit around corresponding, opposed cathodes instead of fitting between them.

DETAILED DESCRIPTION OF THE PREFERRED EMBODIMENTS

Figure 1:
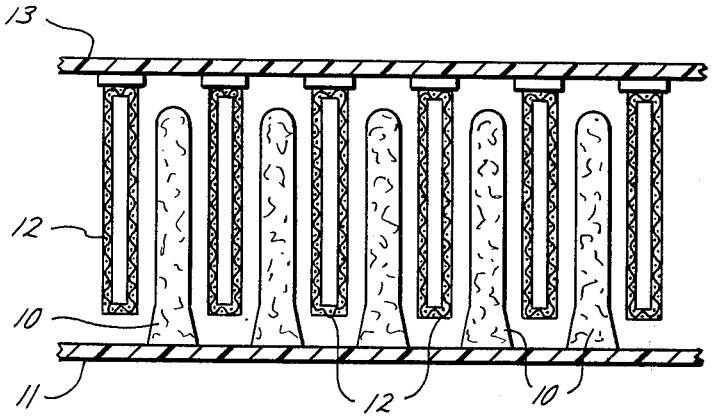
Fig. 1 PRIOR ART
FIG. 1 is a plan view of cathode pockets interleaved between anode fingers as they are typically done in the prior art.

This invention can best be understood by first contrasting it with the prior art. FIG. 1 is an illustrative example of the relationship between parallel cathode pockets with respect to parallel anode fingers in the prior art. That relationship has been one where the cathode pockets 10 have been interleaved between anode fingers 12. Anode fingers 12 are mechanically and electrically attached to anode base 13. Cathode pockets 10 and likewise attached to cathode base 11.

Figure 2:
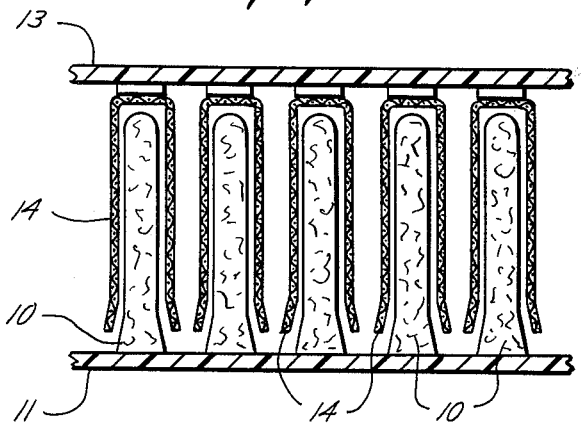
FIG. 2 is a plan view of cathode pockets with U-shaped, or C-shaped, or tuning fork-shaped anodes fitted around cathode pockets according to this invention.

By contrast the present invention has its tuning fork-shaped, or U-shaped, or C-shaped anodes 14 fitted around the cathodes pockets 10 instead of between them as can be seen in FIG. 2. Anodes 14 are electrically and mechanically connected to anode base 13.

Figure 3:
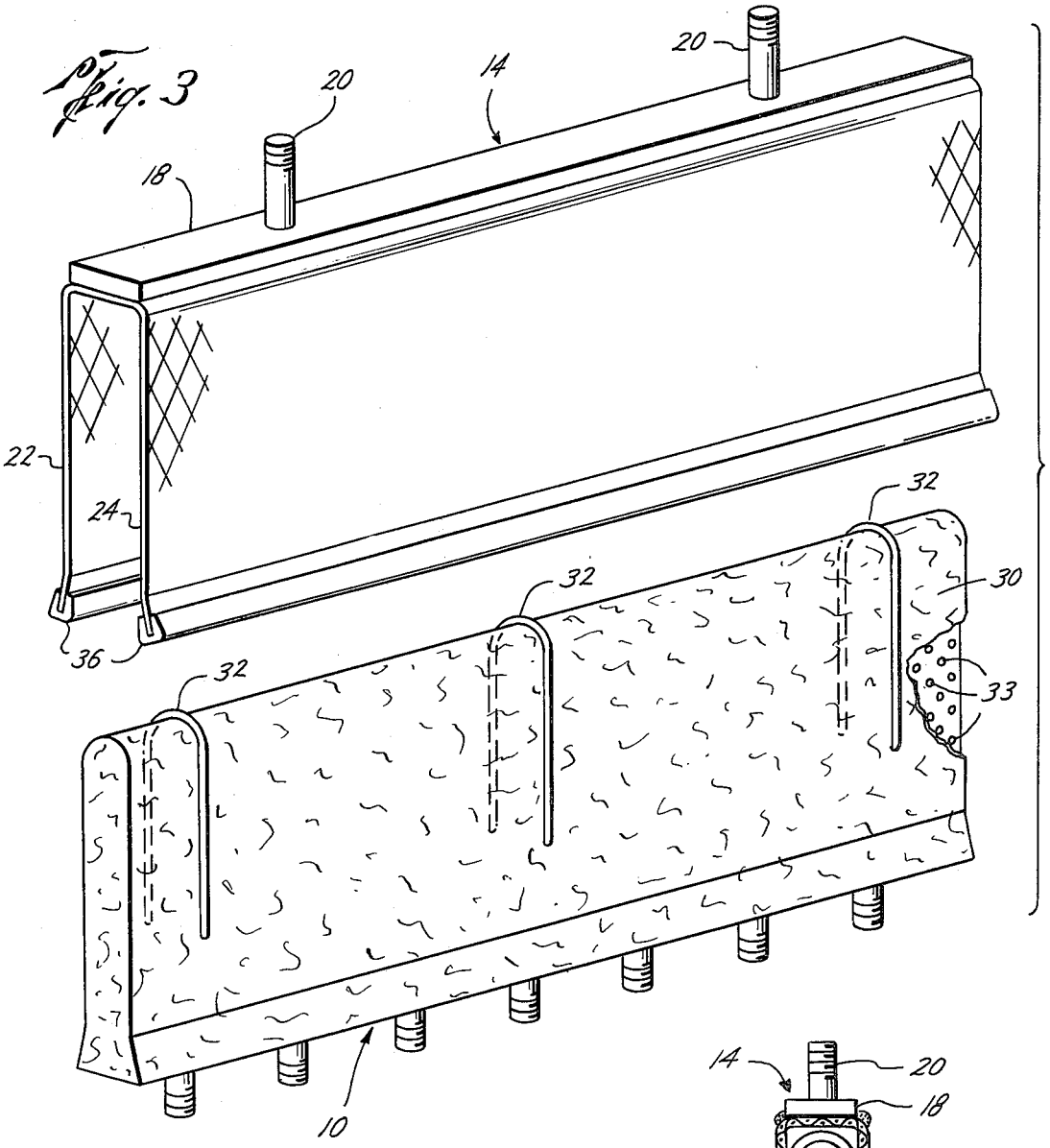
FIG. 3 is an exploded, isometric view of an anode-cathode pocket assembly according to this invention.

A better understanding of this component relationship may perhaps be obtained by referring to the exploded view of the U-shaped anode 14 and its corresponding cathode 10 shown in FIG. 3. In brine electrolysis, a cell anode 14 would fit around cathode 10 as shown in the top view of an anode-cathode assembly of FIG. 4.

Figure 5:
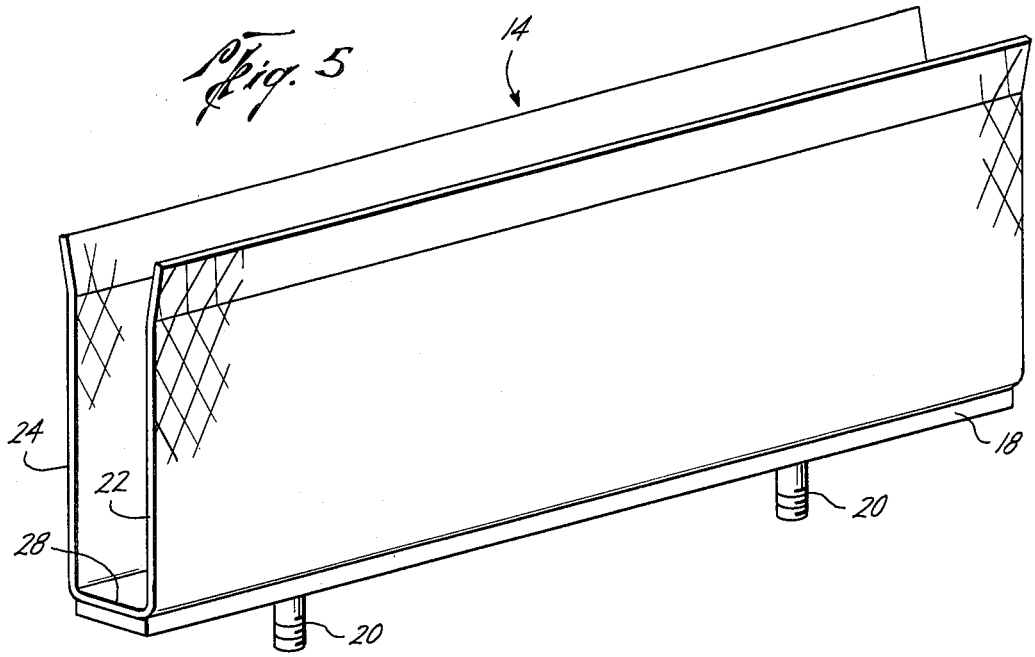
FIG. 5 is an isometric view of one of the U-shaped anodes of this invention.
Figure 6:
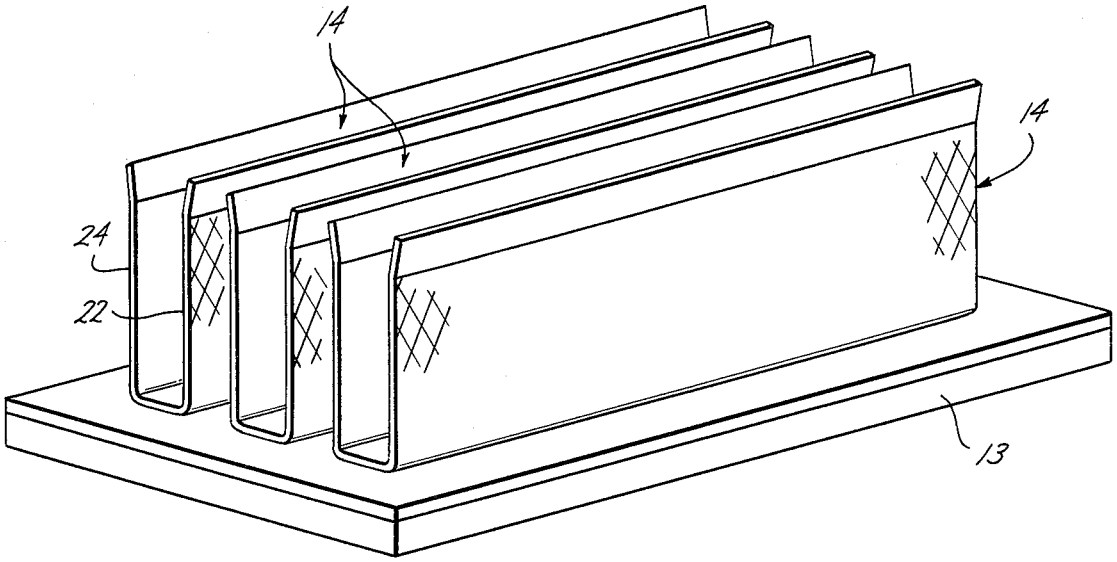
FIG. 6 is an isometric view of three U- or C-shaped anodes directly welded to an anode base.

An isometric view of one embodiment of the tuning fork anode 14 shown by itself can be seen in FIG. 5. An isometric view of an alternative embodiment of the U-shaped anode 14*a* can be seen in FIG. 6. The principle difference between these two embodiments is in their means of attachment to the anode base 13. The anode 14 of FIG. 6 is attached directly to metal anode base 13 by means such as welding whereas the anode 14 is attached to a backbar 18 by welding and this backbar 18 is attached to the anode base 13 by means such as studs 20 welded to backbar 18.

Another alternative embodiment of anode 14, (not shown, but which can be visualized by referring to FIG. 5) is two separate working faces welded to backbar 18 instead of bending one metal sheet into a U-shape and welding it to backbar 18, as shown in FIG. 5.

The working faces 22, 24 of tuning fork-shaped anodes 14 are made of a metal which can withstand the corrosive (low pH, high temperature brine-chlorine) environment in the anolyte compartment of a brine electrolysis cell. Typical metals are those mentioned above in the background of the invention. Ruthenium oxide coated titanium metal mesh is preferred. These anode working faces 22, 24 are to be foraminous although it is not necessary that they be so.

Working faces 22, 24 are flat and spaced sufficiently far enough apart to allow cathode pocket 10 to fit between them. Generally, flat working faces 22, 24 are parallel, but they are not limited to being so. For example they can flare apart to accommodate a wedged shaped cathode pocket. What is desirable is that these working faces are parallel to and spaced from their corresponding cathode pocket 10 working face so as to form a discrete, uniformly spaced gap 26 (see FIG. 4) between said anode working face and its corresponding cathode pocket working face. By "corresponding cathode pocket working face", what is meant herein is that flat part of the cathode pocket 10 inside the U-shaped anode 14 which is closest to the anode working face of that anode 14.

Preferably this U- or C-shaped anode is formed from one sheet of metal by bending it into the U- or C-shaped shown in the drawings. (See FIGS. 5 and 6 in particular).

In FIG. 5, the base of the U-shaped metal anode is shown welded to a metal, preferably titanium, backbar 18. Backbar 18 has studs 20 welded to it to enable the whole anode 14 to be bolted to an anode base 13 (not shown in FIG. 5).

Using FIG. 5 as a guide another embodiment of anode 14 can be described. In FIG. 5 a large, single sheet of metal is bent into a U-shape to form working faces 22 and 24 and a base 28 to which to weld to backbar 18. Alternatively two smaller, flat sheets of metal can be welded to the sides of backbar 18 and still form a U-shaped or C-shaped or tuning fork shaped anode suitable for this invention. Of course, this embodiment, as do all embodiments, of the anode 14 require working faces 22, 24 to be open and disconnected from one another at the far end from the base 28 of their U-shape so that they can fit around their corresponding cathode pocket 10. (See FIG. 4).

Referring to FIG. 6, another embodiment of anode 14 can be seen. Here we have an anode 14 which does not have backbar 18, yet it is still a tuning fork anode quite comportable with this invention since it fits around cathode pockets instead of fitting between them.

Figure 4:
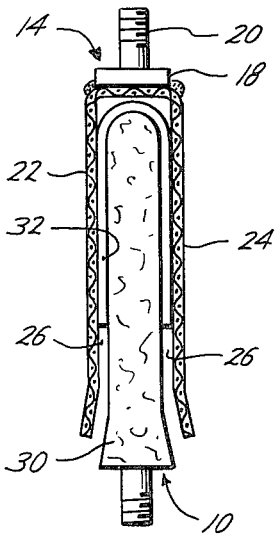
FIG. 4 is a plan view of a C-shaped anode fitted around a cathode pocket according to the anode-cathode pocket assembly of this invention.

There are many types of cathodes 10 around which the C- or U-shaped anodes 14 of this invention will fit. The ones depicted in the drawings happen to be cathode pockets 10 which are the type most often used in the electrolysis of brine. Moreover, they are of the diaphragm type most often used with the electrolysis of brine to produce chlorine and caustic. The diaphragm 30 is shown in FIGS. 3 and 4 to be made of asbestos. Asbestos however does not preclude the use of permselective membranes such as the well-known Nafion membranes made by E. I. duPont de Nemours Company.

As can be seen in FIG. 3, the pocket of cathode 10 is foraminous metal 33.

It should be noted here, however, that although diaphragms 30 are shown and membranes are discussed, their presence is not necessary for this invention. Their presence is necessary to produce free chlorine gas and caustic in a chlor-alkali electrolysis cell, but their presence is not necessary in a chlorate cell, and the cathode-anode assembly of this invention is useful in chlorate cells as well as chlor-alkali cells.

Returning now to a discussion of the gap 26 alluded to above which is desired to be maintained between the working faces 22, 24 of the anode 14 and the corresponding working faces of cathode 10 maintained between these anode working faces 22, 24. Devices referred to as "hairpins" 32 can be employed to maintain a gap 26 of the constant width desired. (See FIG. 4 for depiction of gap 26).

Hairpins 32 are flexible, noncorrosive, U-shaped articles which are friction-fitted around cathode pocket 10. Typically they are made of a plastic material. After hairpins 32 are fitted around the leading edge of cathode 10, then U-shaped anode 14 is fitted around cathode 10 and hairpins 32. The working faces 22, 24 of anode 14 are best tapered together somewhat during construction so that when they are fitted around cathode 10 and hairpins 32 they will fit snugly against hairpins 32 so as to maintain a constant gap width due, by utilizing the spring-resiliency of the metal.

Hairpins 32 serve another useful function also. During the placement of anode 14 around cathode 10, hairpins 32 protect the diaphragm 30 (or its membrane substitute) from abrasion by the working faces 22, 24 as they are slipped around the diaphragm 30. Another such diaphragm protection device is edge protector 36 located on the leading, often sharp, edges of working faces 22, 24. (See FIG. 3). This is made of a soft, noncorrosive material such as polyvinylchloride.

Another diaphragm abrasion preventive feature is to bend the leading edges of anode working faces 22, 24 outwardly away from the anode interior as is shown in FIGS. 3, 5 and 6.

Having fully described the invention, we claim:

1. In a brine electrolysis cell containing a plurality of spaced, vertically oriented anodes and cathodes whose working faces are flat and substantially parallel to each other, said anodes being attached at one edge to an anode base and said cathodes being attached to a cathode base, the improvement which comprises:

anodes which are C- or U-shaped and which are each directly attached to the anode base at the base of their C- or U-shape in such a fashion so that each one of them fit around a corresponding cathode pocket instead of fitting between them, and wherein the leading edges of the anode working faces are bent outwardly away from the anode interior.

2. The electrolysis cell of claim 1 which further comprises a percolating diaphragm means disposed between adjacent anode and cathode pocket working faces.

3. The electrolysis cell of claim 2 wherein the percolating diaphragm means is an asbestos-type diaphragm.

4. The electrolysis cell of claim 1 which further comprises a permselective membrane means disposed between adjacent anode and cathode pocket working faces.

5. The improvement of claim 1, 2, 3, or 4 wherein an edge protector is located on the leading edges of the anode's working faces.

6. In a brine electrolysis cell containing a plurality of spaced, vertically oriented anodes and cathodes whose working faces are flat and substantially parallel to each other, said anodes being attached at one edge to an anode base and said cathodes being attached to a cathode base, the improvement which comprises:

anodes which are C- or U-shaped and which are each directly attached to the anode base at the base of their C- or U-shape in such a fashion so that each one of them fit around a corresponding cathode pocket instead of fitting between them, and wherein an edge protector is located on the leading edge of the anode's working faces.

7. The electrolysis cell of claim 6 which further comprises a percolating diaphragm means disposed between adjacent anode and cathode pocket working faces.

8. The electrolysis cell of claim 7 wherein the percolating diaphragm means is an asbestos-type diaphragm.

9. The electrolysis cell of claim 7 which further comprises a permselective membrane means disposed between adjacent anode and cathode pocket working faces.

* * * * *